US007195294B1

(12) United States Patent
White

(10) Patent No.: US 7,195,294 B1
(45) Date of Patent: Mar. 27, 2007

(54) DOOR BRACE

(76) Inventor: Vernard White, 781 Best Ridge Rd., Sylvania, GA (US) 30467

( * ) Notice: Subject to any disclaimer, the term of this patent is extended or adjusted under 35 U.S.C. 154(b) by 81 days.

(21) Appl. No.: 11/158,780

(22) Filed: Jun. 23, 2005

(51) Int. Cl.
*E05C 19/00* (2006.01)
*E05C 17/44* (2006.01)

(52) U.S. Cl. ..... 292/259 R; 292/338; 292/DIG. 15; 292/DIG. 65; 70/101; 70/94

(58) Field of Classification Search ..... 292/259 R, 292/288–260, 291, 300, DIG. 65, DIG. 16, 292/338–339; 248/251, 351; 52/127.1, 52/127.2; 70/14, 94, 158–173, 57–58; 254/39; 16/83; 49/395, 141
See application file for complete search history.

(56) References Cited

U.S. PATENT DOCUMENTS 4,078,836 A * 3/1978 Wilson ..... 292/259 R
4,079,972 A 3/1978 Hagopian
4,438,640 A 3/1984 Willis
4,462,625 A 7/1984 Barnhill
4,548,436 A * 10/1985 Cole, Jr. ..... 292/292
4,852,921 A * 8/1989 Gilbert et al. ..... 292/259 R
5,580,108 A * 12/1996 Bergstein ..... 292/259 R
5,873,273 A * 2/1999 Vick ..... 70/101
6,352,290 B1 3/2002 Scottino
6,705,652 B2 3/2004 Engel

* cited by examiner

*Primary Examiner*—Brian E. Glessner
*Assistant Examiner*—Alyson Merlino

(57) ABSTRACT

An anchor bracket is positional on a ground surface interior of the door opposite the base. An anchor bracket and the base lie along a horizontal plane. A bar extending across the door is pivotal about an axis extending parallel to a ground surface. Such a bar includes upper and lower portions, each having an aperture therein. The upper portion extends away from the outer edge of the door such that the upper portion is aligned to the top of the shaft and is positional in the slot. The upper portion is connected to the top of the shaft. The lower portion is connected to the anchor bracket. The bar includes a hook located on top of the shaft and positional about the door knob. The shaft and the bar are positioned interior of a door. The bar extends from the anchor bracket to the shaft and terminates midway of the door.

12 Claims, 3 Drawing Sheets

DOOR BRACE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to door braces and, more particularly, to a door brace for mobile home doors.

2. Prior Art

Heretofore, conventional safety devices or door fasteners were used whereby the door fasteners were small insignificant locking mechanisms. In the present days of mass burglarization of every type, it is of public concern to protect oneself within the confines of one's private home or a motel room. There is a need for a more effective way of keeping outside intruders from breaking and entering the individual's private confinement.

Examples of numerous approaches to prevent intrusion include several safety devices such as latches, small fasteners of stamped metal and other securing devices. Most of these securing devices are concentrated around the door's lock area and have not done the job satisfactorily. The intruder could use burglarizing instruments inserted into the room between the door frame and the door to unlatch the safety devices and enter the room. Other archaic devices were used for double locking the doors but did not solve the problem of preventing the breaking and entering of motel rooms or private homes. In order to prevent this breaking and entering, this invention provides for a cross bracing concept of bridging the door horizontally or diagonally by means of a reinforced bar or beam that could be only removed by someone within the room.

Accordingly, a need remains for a door brace in order to overcome the above-noted shortcomings. The present invention satisfies such a need by providing a door brace that is practical, effective, easy to install, convenient, and simple in operation. It can advantageously be used with various brands, models, and sizes of doors. The door brace appeals to private business owners, homeowners, security professionals, etc. The door brace also appeals to any location where doors are employed and security is needed.

BRIEF SUMMARY OF THE INVENTION

In view of the foregoing background, it is therefore an object of the present invention to provide a door brace. These and other objects, features, and advantages of the invention are provided by an apparatus for securing and bracing a door.

A door brace includes an elongated and rectilinear shaft having a top portion and a monolithically formed base portion removably positional on a ground surface. Such a shaft extends vertically upward from the base member to a predetermined height and terminates above a door knob. The shaft is effectively and statically disposed adjacent an interior side of the door wherein the shaft is laterally spaced from an outer frame of the door and located proximate to a door knob of the door. The top portion conveniently has a slot formed therein.

An anchor bracket is removably positional on a ground surface located interior of the door and oppositely spaced from the base member. Such an anchor bracket and the base member are registered along a horizontal plane.

A rectilinear bar is advantageously sized and shaped to extend across a width of the door. The bar is preferably formed from steel and pivotal about a fulcrum axis defined along an axis extending parallel to the ground surface. Such a bar includes monolithically formed upper and lower portions, each having an aperture formed therein. The upper portion extends horizontally and laterally away from the outer edge of the door such that the upper portion is orthogonally aligned to the top portion of the shaft and removably positional in the slot. The upper portion is pivotally and directly connected to the top portion of the shaft. The lower portion is pivotally and directly connected to the anchor bracket. The bar conveniently includes a monolithically formed hook member proximately located to the top portion of the shaft and removably positional about the door knob to provide support to the brace. Such a hook member is advantageously sized and shaped to receive a conventional door knob.

The shaft and the bar are effectively positioned interior of a mobile home door such that the door can not be opened to prevent unauthorized access. The bar extends obliquely from the anchor bracket to the shaft and advantageously terminates midway of a height of the door. The base portion and the anchor bracket each conveniently include a plurality of apertures equidistantly spaced about a perimeter thereof respectively for receiving a plurality of fastening members therethrough to secure the base portion and the anchor bracket to a ground surface. The top portion and the anchor bracket may include a plurality of clevis pins removably insertable through the apertures of the bar respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
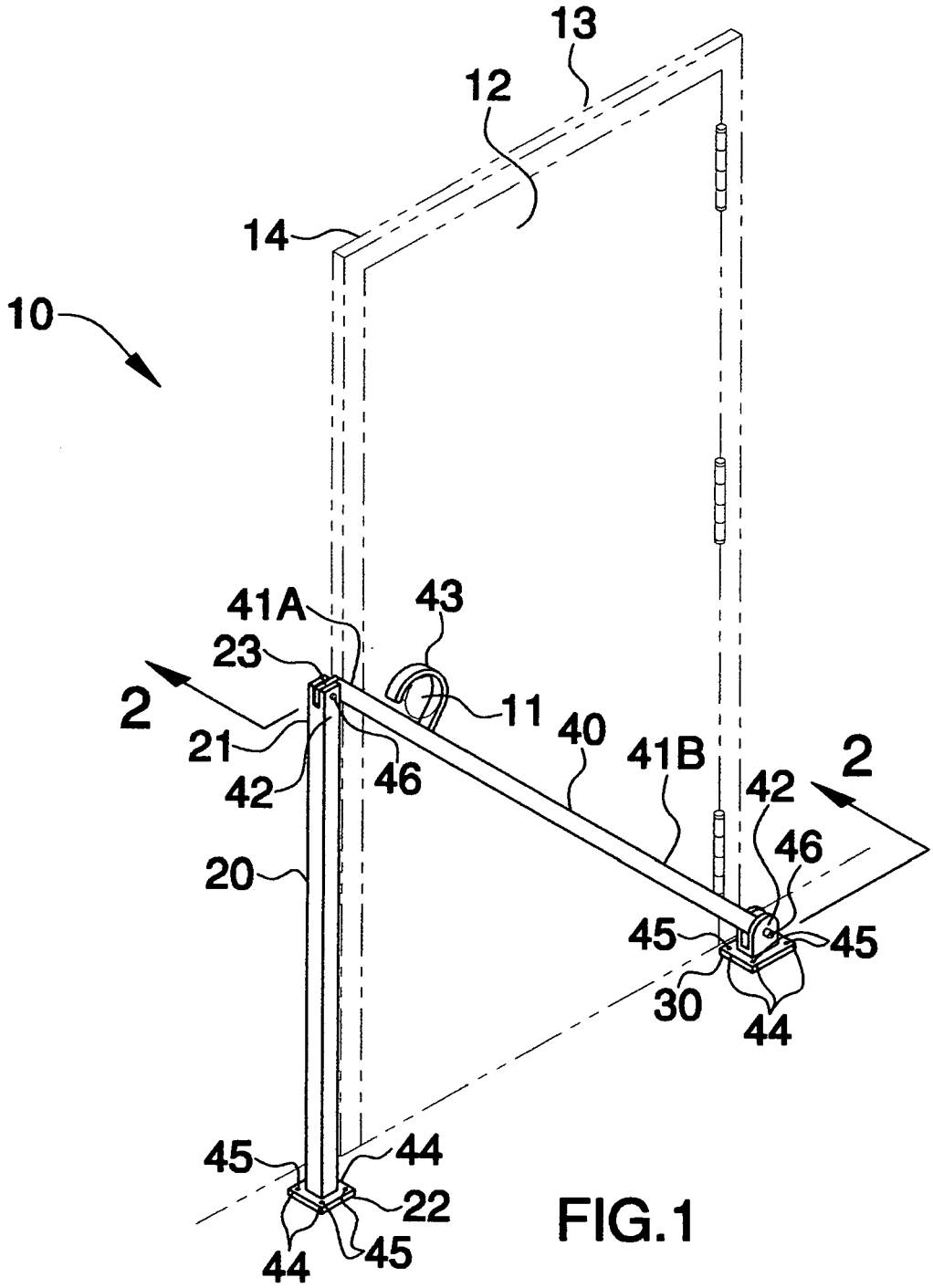
FIG. 1 is a perspective view showing an apparatus for bracing a door, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a door brace. It should be understood that the apparatus 10 may be used to brace many different types of entryway panels and should not be limited in use only to doors.

Figure 2:
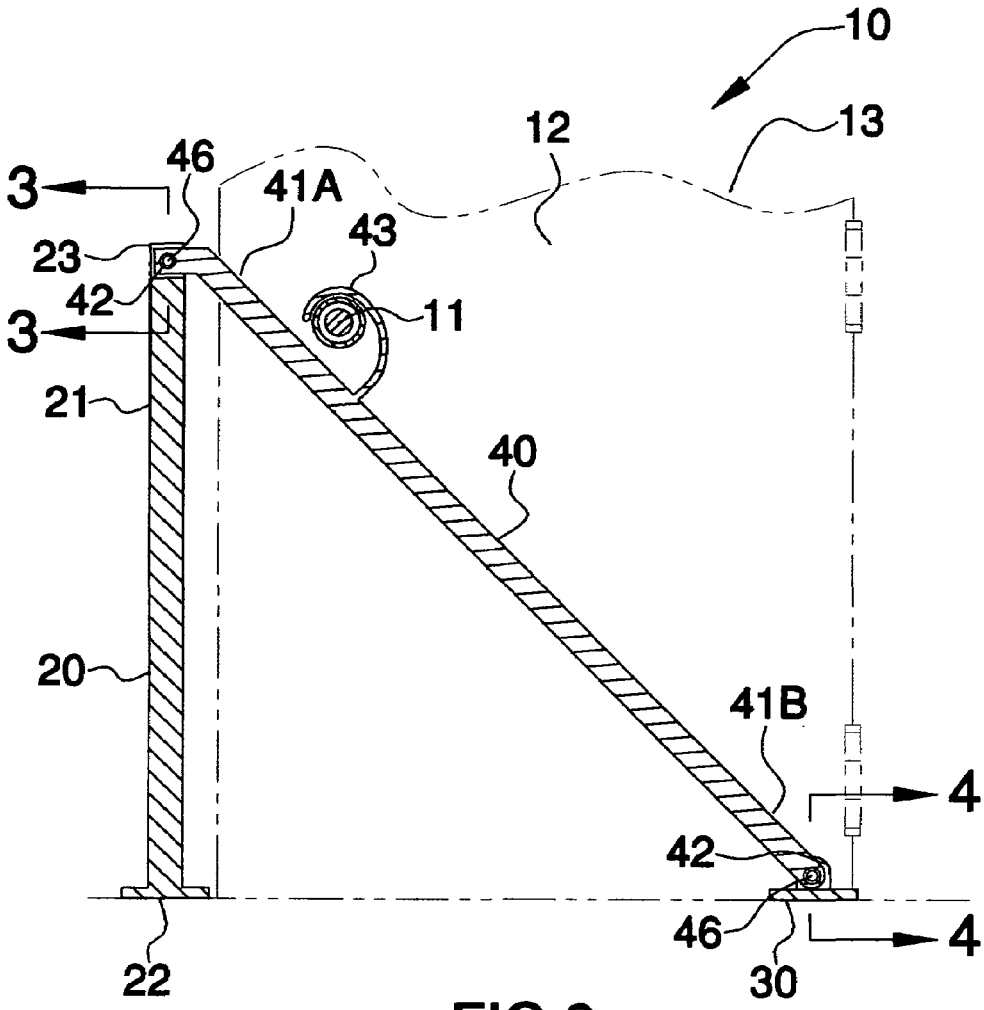
FIG. 2 is a cross-sectional view of the apparatus shown in FIG. 1, taken along line 2—2.

Referring initially to FIGS. 1 and 2, the apparatus 10 includes an elongated and rectilinear shaft 20 having a top portion 21 and a monolithically formed base portion 22 removably positional on a ground surface. Such a shaft 20 extends vertically upward from the base member 22 to a predetermined height and terminates above a door knob 11. This important feature allows the apparatus 10 to obtain proper leverage during operating conditions, thereby resulting in efficient and proper functioning. The shaft 20 is effectively and statically disposed adjacent an interior side 12 of the door 13 wherein the shaft 20 is laterally spaced from an outer frame 14 of the door 13 and located proximate to a door knob 11 of the door 13. The top portion 21 conveniently has a slot 23 formed therein. An anchor bracket 30 is removably positional on a ground surface located interior of the door 13 and oppositely spaced from the base member 22. Such an anchor bracket 30 and the base member 22 are registered along a horizontal plane.

Referring again to FIGS. 1 and 2, a rectilinear bar 40 is advantageously sized and shaped to extend across a width of the door 13. The bar 40 is formed from steel and is pivotal about a fulcrum axis defined along an axis extending parallel to the ground surface. This is critical to the apparatus 10 as it allows the bar 40 to be quickly and conveniently relocated to allow the door to resume normal operation. Such a bar 40 includes monolithically formed upper 41A and lower 41B portions, each having an aperture 42 formed therein. The upper portion 41A extends horizontally and laterally away from the outer edge of the door 13 such that the upper portion 41A is orthogonally aligned to the top portion 21 of the shaft 20 and removably positional in the slot 23. This important feature permits the bar 40 to effectively traverse the plane of the door 13.

The upper portion 41A is pivotally and directly connected, with no intervening elements, to the top portion 21 of the shaft 20. The lower portion 41B is pivotally and directly connected, with no intervening elements, to the anchor bracket 30. The bar 40 conveniently includes a monolithically formed hook member 43 proximately located to the top portion 21 of the shaft 20 and removably positional about the door knob 11 to provide support to the apparatus 10. Such a hook member 43 is advantageously sized and shaped to receive a conventional door knob 11. This is necessary to the invention in that it effectively supports the apparatus 10 while preventing any rotational movement of the door 13. The upper portion 41A of the bar 40 and the top portion 21 of the shaft 20 will absorb the majority of the energy expended in an attempted intrusion. The addition of the hook member 43 creates a synergistic effect when combined with the shaft 20 and the bar 40, thereby bolstering the strength of the apparatus 10.

Referring again to FIGS. 1 and 2, the shaft 20 and the bar 40 are effectively positioned interior of a mobile home door 13 such that the door 13 can not be opened to prevent unauthorized access. The bar 40 extends obliquely from the anchor bracket 30 to the shaft 20 and advantageously terminates midway of a height of the door 13. The base portion 22 and the anchor bracket 30 each conveniently include a plurality of apertures 44 equidistantly spaced about a perimeter thereof respectively for receiving a plurality of fastening members 45 therethrough to secure the base portion 22 and the anchor bracket 30 to a ground surface.

Figure 3:
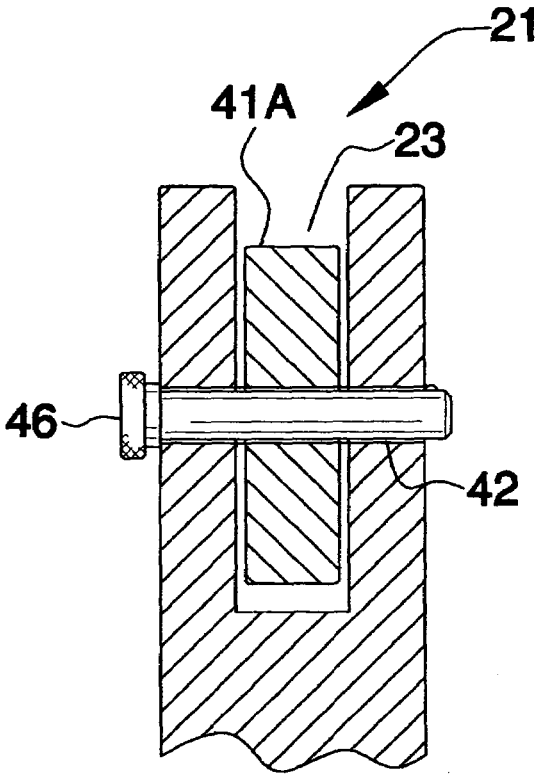
FIG. 3 is a cross-sectional view of the apparatus shown in FIG. 2, taken along line 3—3.
Figure 4:
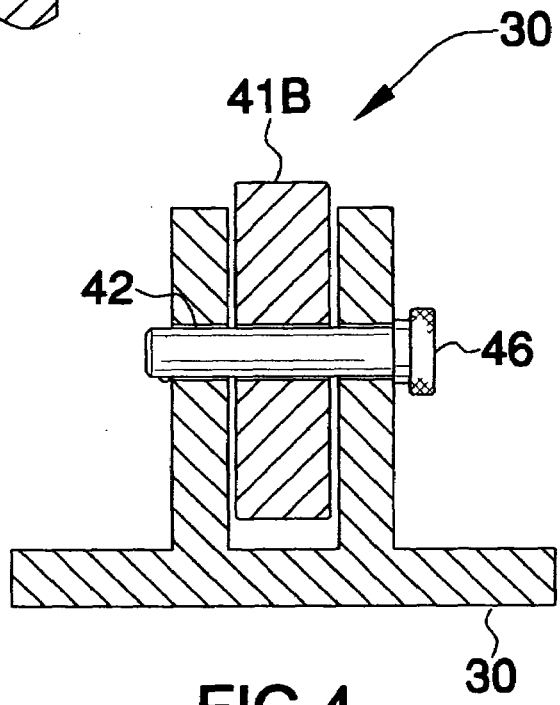
FIG. 4 is a cross-sectional view of the apparatus shown in FIG. 2, taken along line 4—4.

Referring to FIGS. 3 and 4, the top portion 21 and the anchor bracket 30 effectively include a plurality of clevis pins 46 removably insertable through the apertures 42 of the bar 40 respectively. The clevis pins 46 are essential to the apparatus 10 in order to firmly secure the upper 41A and lower 41B portions of the bar 40 to the top portion 21 of the shaft 20 and the anchor bracket 30, respectively. This is critical to the invention because the clevis pins 46 also serve to increase the overall sturdiness of the apparatus 10, yet are readily removable if a user decides to relocate the device 10.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A door brace reinforcing a mobile home door to prevent unauthorized entry, said brace comprising;

an elongated and rectilinear shaft having a top portion and a monolithically formed base portion removably positional on a ground surface, said shaft extending vertically upward from said base member to a predetermined height and terminating above a door knob, said shaft being statically disposed adjacent an interior side of the door wherein said shaft is laterally spaced from an outer frame of the door and located proximate to a door knob of the door, said top portion having a slot formed therein;

an anchor bracket removably positional on a ground surface located interior of the door and oppositely spaced from said base member, said anchor bracket and said base member being registered along a horizontal plane; and a rectilinear bar sized and shaped to extend across a width of the door, said bar including monolithically formed upper and lower portions each having an aperture formed therein, said upper portion extending horizontally and laterally away from the outer edge of the door such that said upper portion is orthogonally aligned to said top portion of said shaft and removably positional in the slot, said upper portion being pivotally and directly connected to said top portion of said shaft, said lower portion being pivotally and directly connected to said anchor bracket, said bar including a monolithically formed hook member proximately located to said top portion of said shaft and removably positional about the door knob to provide support to said brace;

wherein said shaft and said bar are positioned interior of a mobile home door such that the door can not be opened to prevent unauthorized access.

2. The door brace of claim 1, wherein said base portion and said anchor bracket each include a plurality of apertures equidistantly spaced about a perimeter thereof respectively for receiving a plurality of fastening members therethrough to secure said base portion and said anchor bracket to a ground surface.

3. The door brace of claim 1, wherein said top portion and said anchor bracket include a plurality of clevis pins removably insertable through the apertures of said bar respectively.

4. The door brace of claim 1, wherein said hook member is sized and shaped to receive a conventional door knob.

5. A door brace reinforcing a mobile home door to prevent unauthorized entry, said brace comprising;

an elongated and rectilinear shaft having a top portion and a monolithically formed base portion removably positional on a ground surface, said shaft extending vertically upward from said base member to a predetermined height and terminating above a door knob, said shaft being statically disposed adjacent an interior side of the door wherein said shaft is laterally spaced from an outer frame of the door and located proximate to a door knob of the door, said top portion having a slot formed therein;

an anchor bracket removably positional on a ground surface located interior of the door and oppositely spaced from said base member, said anchor bracket and said base member being registered along a horizontal plane; and a rectilinear bar sized and shaped to extend across a width of the door, said bar including monolithically formed upper and lower portions each having an aperture formed therein, said upper portion extending horizontally and laterally away from the outer edge of the door such that said upper portion is orthogonally aligned to said top portion of said shaft and removably positional in the slot, said upper portion being pivotally and directly connected to said top portion of said shaft, said lower portion being pivotally and directly connected to said anchor bracket, said bar extending obliquely from said anchor bracket to said shaft and terminating midway of a height of the door, said bar including a monolithically formed hook member proximately located to said top portion of said shaft and removably positional about the door knob to provide support to said brace;

wherein said shaft and said bar are positioned interior of a mobile home door such that the door can not be opened to prevent unauthorized access.

6. The door brace of claim 5, wherein said base portion and said anchor bracket each include a plurality of apertures equidistantly spaced about a perimeter thereof respectively for receiving a plurality of fastening members therethrough to secure said base portion and said anchor bracket to a ground surface.

7. The door brace of claim 5, wherein said top portion and said anchor bracket include a plurality of clevis pins removably insertable through the apertures of said bar respectively.

8. The door brace of claim 5, wherein said hook member is sized and shaped to receive a conventional door knob.

9. A door brace reinforcing a mobile home door to prevent unauthorized entry, said brace comprising;

an elongated and rectilinear shaft having a top portion and a monolithically formed base portion removably positional on a ground surface, said shaft extending vertically upward from said base member to a predetermined height and terminating above a door knob, said shaft being statically disposed adjacent an interior side of the door wherein said shaft is laterally spaced from an outer frame of the door and located proximate to a door knob of the door, said top portion having a slot formed therein;

an anchor bracket removably positional on a ground surface located interior of the door and oppositely spaced from said base member, said anchor bracket and said base member being registered along a horizontal plane; and a rectilinear bar sized and shaped to extend across a width of the door, said bar being formed from steel and pivotal about a fulcrum axis defined along an axis extending parallel to the ground surface, said bar including monolithically formed upper and lower portions each having an aperture formed therein, said upper portion extending horizontally and laterally away from the outer edge of the door such that said upper portion is orthogonally aligned to said top portion of said shaft and removably positional in the slot, said upper portion being pivotally and directly connected to said top portion of said shaft, said lower portion being pivotally and directly connected to said anchor bracket, said bar including a monolithically formed hook member proximately located to said top portion of said shaft and removably positional about the door knob to provide support to said brace;

wherein said shaft and said bar are positioned interior of a mobile home door such that the door can not be opened to prevent unauthorized access, said bar extending obliquely from said anchor bracket to said shaft and terminating midway of a height of the door.

10. The door brace of claim 9, wherein said base portion and said anchor bracket each include a plurality of apertures equidistantly spaced about a perimeter thereof respectively for receiving a plurality of fastening members therethrough to secure said base portion and said anchor bracket to a ground surface.

11. The door brace of claim 9, wherein said top portion and said anchor bracket include a plurality of clevis pins removably insertable through the apertures of said bar respectively.

12. The door brace of claim 9, wherein said hook member is sized and shaped to receive a conventional door knob.

* * * * *